United States Patent [19]

Jones

[11] 4,109,327

[45] Aug. 29, 1978

[54] WATER CLOSET FLANGE WITH CONTINUOUS BOLT SLOT

[76] Inventor: Basil B. Jones, Rte. 1, Box 536A, St. Cloud, Fla. 32769

[21] Appl. No.: 780,068

[22] Filed: Mar. 22, 1977

Related U.S. Application Data

[63] Continuation-in-part of Ser. No. 586,161, Jun. 12, 1975, Pat. No. 4,014,053.

[51] Int. Cl.[2] ..... E03D 11/00

[52] U.S. Cl. ..... 4/252 R; 4/420; 285/56

[58] Field of Search ..... 4/68, 252 R, 1; 285/56–60, 376, 401, 402

[56] References Cited

U.S. PATENT DOCUMENTS

| | | | |
|---|---|---|---|
| 900,594 | 10/1908 | Rice | 285/60 |
| 1,112,360 | 9/1914 | Crosby | 285/56 |
| 2,488,816 | 11/1949 | Heaton | 285/56 X |
| 2,549,357 | 4/1951 | Angalone | 285/56 X |
| 3,012,252 | 12/1961 | Gaddy | 4/252 R |
| 3,015,501 | 1/1962 | Minella | 285/58 |
| 3,263,244 | 8/1966 | Katz | 4/252 R |

*Primary Examiner*—Henry K. Artis
*Attorney, Agent, or Firm*—James B. Middleton

[57] ABSTRACT

A water closet flange for mounting a water closet, the mounting flange having a flange with a continuous bolt slot so that the closet bolts can be located anywhere around the 360° of the flange, a central opening concentric with the bolt slot, and an extension for connecting the flange to the appropriate sewer pipes. The bolt slot is formed with a bottom which limits the downward movement of the closet bolts.

7 Claims, 5 Drawing Figures

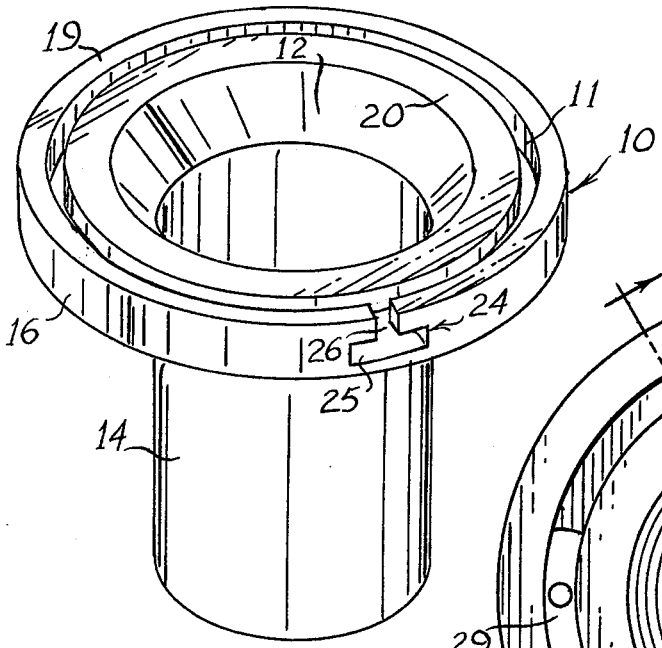
Fig. 1
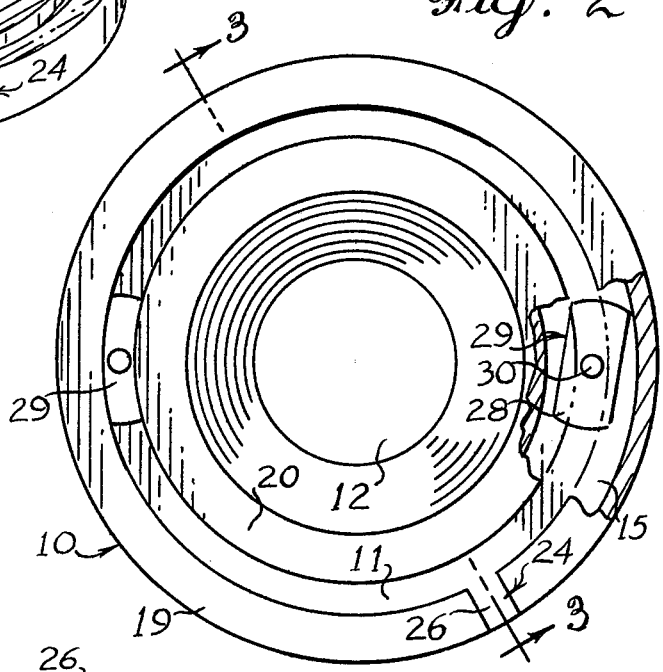
Fig. 2
Fig. 3
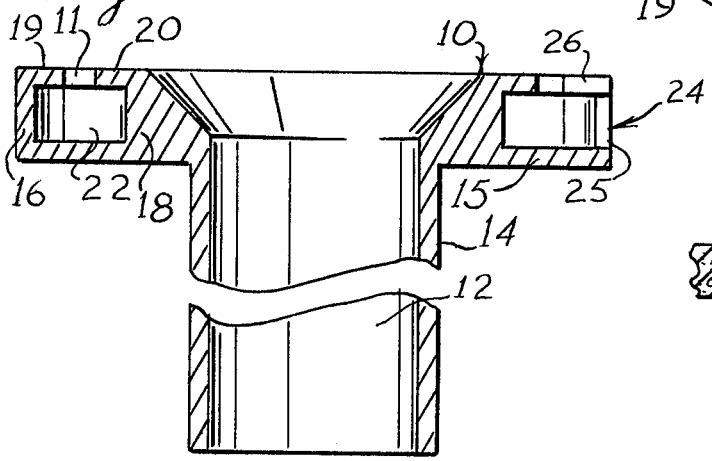
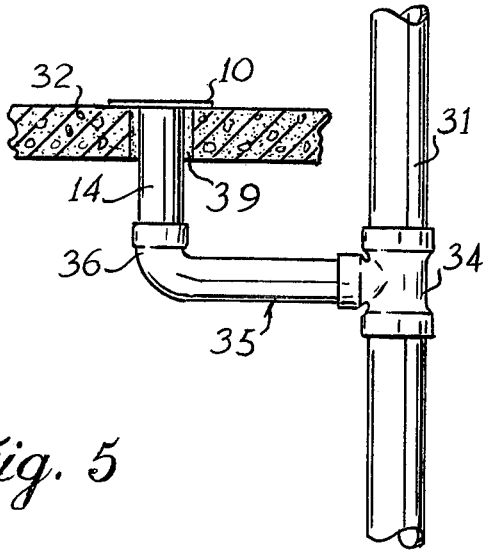
Fig. 4
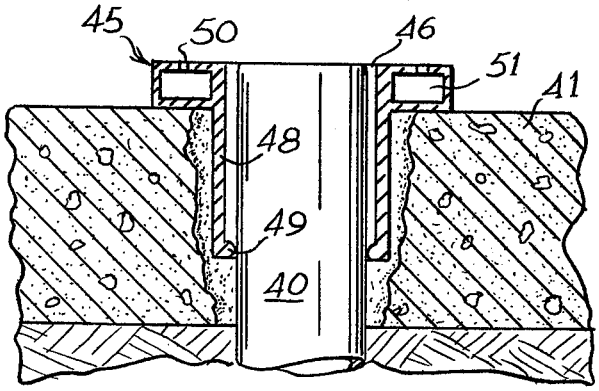
Fig. 5

WATER CLOSET FLANGE WITH CONTINUOUS BOLT SLOT

This application is a continuation-in-part of the copending application of Basil B. Jones, filed June 12, 1975, having Ser. No. 586,161, which will issue on Mar. 29, 1977, as U.S. Pat. No. 4,014,053.

This invention relates generally to mounting devices, and is more particularly concerned with a mounting flange for a water closet, the new and novel mounting flange of the present invention having a continuous bolt slot.

The conventional installation of water closets, especially in multi-story buildings, normally entails the installation of risers that extend vertically through the several floors, the risers including a tee joint somewhat below each floor. From this tee joint, a "quarter bend" extends, a "quarter bend" being a short length of pipe terminating in an elbow. The quarter bend extends generally horizontally out, and the closet stub then extends up from the elbow through the floor.

After the piping is in place, someone must go to each closet stub and cut the stub to proper length. A water closet flange must then be installed around the closet stub, and the flange must be carefully placed so the bolt holes in the flange will allow the closet bowl to be mounted with the desired orientation.

The conventional water closet flanges have the above noted disadvantage of requiring careful placement to assure proper location of the water closet mounting bolts, but there are other undesirable features also inherent in the conventional flanges. The bolt holes, or slots, are generally openings in a relatively narrow strip of material so that the holes weaken the flange. The weakened flange is likely to crack, either in shipment or in tightening down a closet bowl. Also, a joint must be made when the closet stub is installed, then another joint must be made when the closet flange is installed around the closet stub. Since each joint must be packed with oakum, then sealed with lead, each joint is very time consuming and requires skilled labor.

The present invention overcomes the above mentioned and other difficulties with the prior art water closet flanges by providing a water closet flange having a continuous bolt slot. The bolt slot extends around the flange so the closet bolts can be placed to orient the closet bowl as desired regardless of the placement of the flange. The flange of the present invention may also include a flange extension. The flange extension can be such as to be received directly into the bell of the quarter bend for upper floors, thereby eliminating the closet stub and eliminating one joint for each water closet. In the ground floor, the flange extension may take the form of a sleeve to receive a closet stub and allow the usual caulked joint.

These and other features and advantages of the present invention will become apparent from consideration of the following specification when taken in conjunction with the accompanying drawing in which:

FIG. 1 is a perspective view of a water closet flange made in accordance with the present invention, the embodiment shown in FIG. 1 having the extension for use on upper floors of a building;

FIG. 2 is a top plan view of the mounting flange shown in FIG. 1, portions thereof being broken away;

FIG. 3 is a cross-sectional view taken substantially along the line 3—3 in FIG. 2;

FIG. 4 is an illustration showing the installation of the flange shown in FIGS. 1—3; and, FIG. 5 is a cross-sectional view showing a mounting flange made in accordance with the present invention and having an extension for connecting to a closet stub.

Referring now more particularly to the drawing and to those embodiments of the invention here chosen by way of illustration, it will be seen in FIG. 1 that the device includes a water closet flange generally designated at 10, the flange 10 including a bolt slot 11. Centrally of the flange 10 there is an opening 12 adapted to receive the horn (not shown) through which material is discharged from a water closet.

The flange 10 has fixed thereto a flange extension 14, the extension 14 having a central bore concentric with the opening 12 in the flange 10. It will be observed that the extension 14 is like a straight piece of pipe, and it is contemplated that this form of extension will replace the conventional closet stub.

Looking at FIGS. 2 and 3 of the drawing for a more detailed understanding of the construction of the water closet flange of the present invention, it will be seen that the flange 10 includes a bottom plate 15 having upwardly extending outer and inner walls 16 and 18 respectively. The upper end of the outer wall 16 has an inwardly directed lip 19, and the upper end of the inner wall 18 has an outwardly directed lip 20. The lips 19 and 20 are concentric but do not meet, thereby forming the slot 11 which communicates with a channel 22 formed between the walls 16 and 18.

As a result of the above described construction, the flange 10 is in the form of a relatively thick body having the slot 11 and channel 22 cut out concentrically with the central opening 12. As here shown, the slot 11 is also concentric with the outside edge of the flange 10. The slot is of course the previously mentioned bolt slot 11, and the channel 22 is of such size as to receive the base of a conventional water closet bolt as will be discussed in more detail hereinafter.

FIGS. 1, 2 and 3 show an entry way 24. One form of such entry way is shown in the application of which the present application is a continuation-in-part (identified hereinabove) and it will be understood by those skilled in the art that many forms of entry way may be devised. The object of the entry way is to allow the bolt of a closet bolt to enter the slot 11 and the base of the closet bolt to enter the channel 22.

The entry way 24 as here illustrated is particularly adapted for casting the flange with the entry way 24 as an integral part of the casting. The entry way 24 includes an elongate slot 25 in the outer wall 16 and an intersecting discontinuity 26 of the lip 19. The result is an inverted T-shape which will allow the base of a closet bolt to pass through the slot 25 while the upstanding bolt portion passes through the discontinuity 26.

With especial attention to FIG. 2 of the drawing, it should be understood that the distance across the channel 22, i.e. the distance between the outer wall 16 and the inner wall 18, must be less than the length of the base 28 of a closet bolt 29. This is necessary so the nut can be tightened on the bolt 30 without the base's turning within the channel 22 and without the necessity of attempting to hold the base to prevent its turning. Because of this necessary relationship, it will be understood that the slot 25 of the entry way 24 must be long enough to allow proper manipulation of the closet bolt 29. The maximum length necessary is of course slightly longer than the longer dimension of the base 28 of the closet bolt 29; however, it may be desirable to minimize the length of the slot 25, and it must be remembered that the closet bolt must have room for the base 28 to enter the channel 22.

It should also be observed that the discontinuity 26 is wide enough to allow the bolt 30 to pass therethrough, but the discontinuity 26 should be maintained sufficiently narrow that the base of a closet bolt will engage the lips 19 and 20 to provide a good holding force even in the vicinity of the discontinuity 26. If too large a portion of the lip 19 is removed, a closet bolt 29 cannot be used at the entry way 24, thereby partially defeating one of the advantages of the present invention.

Looking now at FIG. 4 of the drawing, there is a riser 31 which would pass through the several floors of a multi-story building, one floor 32 being here illustrated. Below the floor 32, there is a tee joint 34 with a quarter bend 35 extending therefrom and terminating in an elbow 36. As discussed above, a closet stub would normally be received in the quarter bend 35, and a closet flange would later be installed on the closet stub. Using the flange of the present invention, however, one would select a flange 10 having an extension 14 of such length as to engage the elbow 36 of the quarter bend 35. It will be understood that it is relatively easy to cut off excess length so the extension 14 does not have to be precisely the right length. The outside diameter of the extension 14 is the appropriate size to be received in the bell of the quarter bend (which is the diameter of the closet stub that would be conventionally installed) and allow a caulked joint to be made.

From the foregoing discussion, it should now be understood by those skilled in the art that, in a multistory building, sleeves could be placed and appropriate holes, such as the hole 39, could be left when the floor 32 is formed. After the floor 32 is set a person can simply drop the flange 10 with the extension 14 passing through the hole 39. The orientation of the flange is of no importance since the bolt slot 11 is continuous, so the placing of the flanges would be quite fast. After the flanges are placed over the holes 39, the appropriate joint would be made with a quarter bend below the floor.

When the water closet is to be mounted on the flange 10, two closet bolts 29 will be passed through the entry way 24 and placed along the slot 11 and channel 22 wherever desired. After the closet bowl is set over the flange 10 with the bolts 30 projecting through the mounting holes in the bowl, the closet bowl can be rotated somewhat for better orientation, and the closet bolts will simply slide along the bolt slot 11. Since the lips 19 and 20 provide an adequate retaining means for the base 28 of the closet bolts 29 throughout 360°, one neet not concern himself about the location of the bolts within the slot 11.

FIG. 5 illustrates a flange made in accordance with the present invention for use primarily on the ground floor of a building where a closet stub projects up from the ground through a concrete floor 41. In this situation it is desirable to use a flange having a relatively short extension that allows a caulked joint.

The flange 45 shown in FIG. 5 is substantially like the flange 10 previously discussed. The central opening 46 in the flange 45 is large enough to receive the closet stub 40 and to provide sufficient space to make a caulked joint. The extension 48 is concentric with the opening 46, the inside diameter of the extension being the same as the opening 46; and, the extension 48 terminates with a bead 49 to retain oakum for making the caulked joint.

It should be understood that the construction of the flange 45 with respect to the bolt slot 50 and the communicating channel 51 is the same as that previously described. Also, an entry way would be provided in the flange 45 to allow closet bolts to enter the bolt slot 50. Thus, when a flange 45 is placed, there is no necessity to consider the orientation because a closet bowl can be oriented as desired with respect to the flange.

It will therefore be seen that the flange of the present invention provides an extremely simple water closet flange that solves numerous problems with conventional flanges. The bolt slot has substantially uniform strength due to the construction, and extends the full 360° around the flange so that a closet bowl can be oriented as desired with respect to the flange. Also, the extension on the flange allows great ease in installation of the necessary piping, conserving both labor and material.

It will of course be understood by those skilled in the art that the particular embodiments of the invention here shown are by way of illustration only, and are meant to be in no way restrictive; therefore, numerous changes and modifications may be made, and the full use of equivalents resorted to, without departing from the spirit or scope of the invention as defined by the appended claims.

I claim:

1. A mounting flange for mounting a water closet, said mounting flange including a flange having a central opening therethrough, said flange defining a continuous bolt slot, said bolt slot being generally concentric with said opening, said bolt being of a width to receive the bolt portion of a closet bolt and narrower than the base of said closet bolt, said flange further defining a channel beneath and coextensive with said bolt slot and in communication therewith, said channel having a width greater than the narrowest dimension of said base portion of said closet bolt and less than the longest dimension of said base portion of said closet bolt.

2. A mounting flange as claimed in claim 1, said flange further defining entry means for allowing said base of said closet bolt to enter said channel.

3. A mounting flange as claimed in claim 1, said flange including a base plate, an outer wall extending upwardly from said base plate, an outer lip on the upper edge of said outer wall, said outer lip providing one side of said bolt slot, an inner wall extending upwardly from said base plate, an inner lip on the upper edge of said inner wall, said inner lip providing the other side of said bolt slot, said outer wall and said inner wall defining the sides of said channel.

4. A mounting flange as claimed in claim 3, at least one of said lips having a discontinuity therein constituting an entry way for said closet bolt.

5. A mounting flange as claimed in claim 3, one of said walls defining a slot therein for receiving the base of a closet bolt, a discontinuity in one of said lips in communication with said slot for receiving the bolt of a closet bolt.

6. A mounting flange as claimed in claim 3, and further including an extension fixed to said flange and concentric with said central opening, said extension having an outside diameter equal to the pipe size of the closet stub that would conventionally be installed for said water closet.

7. A mounting flange as claimed in claim 3, and further including an extension fixed to said flange and concentric with said opening, said extension having an inside diameter properly dimensioned to receive the closet stub that would conventionally be installed for said water closet.

* * * * *

UNITED STATES PATENT AND TRADEMARK OFFICE

CERTIFICATE OF CORRECTION

PATENT NO. : 4,109,327

DATED : August 29, 1978

INVENTOR(S) : Basil B. Jones

It is certified that error appears in the above-identified patent and that said Letters Patent are hereby corrected as shown below:

Claim 1, line 5, the phrase "said bolt being of a width" should be corrected to read --said bolt slot being of a width--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*